United States Patent [19]

Nelson et al.

[11] Patent Number: 4,682,075

[45] Date of Patent: Jul. 21, 1987

[54] IMAGE DISPLAY INCLUDING IMPROVED LIGHT-ABSORBING MATRIX

[75] Inventors: Jordan R. Nelson, Pennington; William K. Wissing, Yardville, both of N.J.

[73] Assignee: RCA Corporation, Princeton, N.J.

[21] Appl. No.: 811,118

[22] Filed: Dec. 19, 1985

[51] Int. Cl.[4] ..... H01J 29/32; H01J 29/28

[52] U.S. Cl. ..... 313/466; 313/474; 252/502

[58] Field of Search ..... 313/474, 408, 461, 466, 313/471, 470, 473; 252/502

[56] References Cited

U.S. PATENT DOCUMENTS

| | | | |
|---|---|---|---|
| 2,134,950 | 1/1938 | Offutt | 23/209 |
| 3,558,310 | 1/1971 | Mayaud | 96/36.1 |
| 3,879,627 | 4/1975 | Robinder | 313/466 X |
| 3,993,739 | 11/1976 | Vanderveen | 423/460 |
| 4,003,082 | 1/1977 | Fumoto | 313/471 X |
| 4,049,452 | 9/1977 | Nekut | 96/36.1 |
| 4,551,652 | 11/1985 | Compen et al. | 313/473 X |
| 4,556,820 | 12/1985 | Thompson | 313/470 |

*Primary Examiner*—Palmer C. DeMeo
*Assistant Examiner*—K. Wieder
*Attorney, Agent, or Firm*—Eugene M. Whitacre; Dennis H. Irlbeck; Vincent J. Coughlin, Jr.

[57] ABSTRACT

An image display including a viewing screen comprising spaced elemental image areas and a light-absorbing matrix of partially-graphitized carbon black adjacent these areas. The matrix may be made by overcoating a stencil and stencil support with an aqueous slurry of the carbon black, drying the overcoating, and then removing the stencil and overlying overcoating.

7 Claims, 4 Drawing Figures

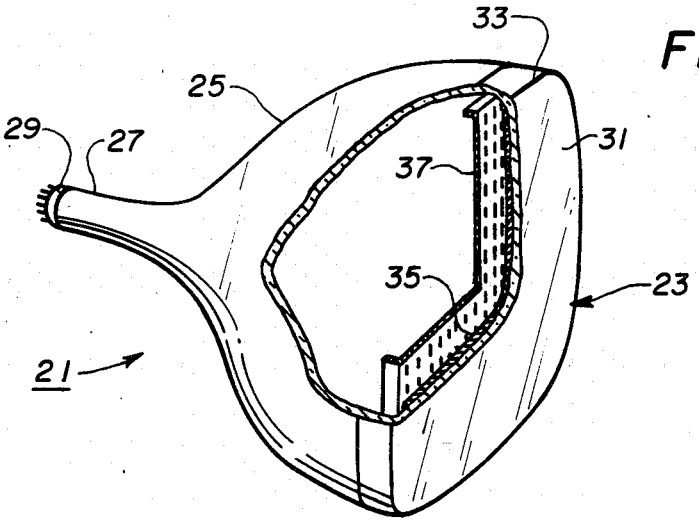
Fig. 1
Fig. 2
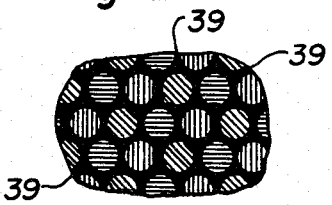
Fig. 3
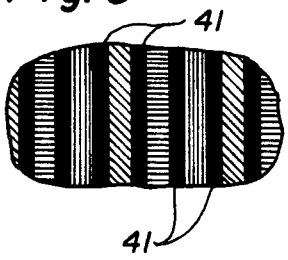
Fig. 4
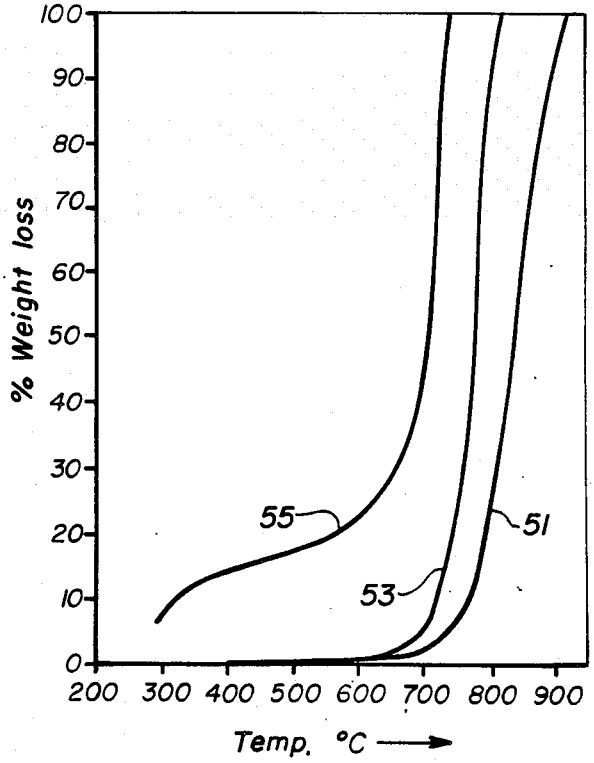

IMAGE DISPLAY INCLUDING IMPROVED LIGHT-ABSORBING MATRIX

This invention relates to a novel image display comprising a light-absorbing matrix and to a novel method for making that matrix. The novel image display may be a CRT (cathode-ray tube) intended for the display in color of video images, data, or other types of information processed by an electronic system.

BACKGROUND OF THE INVENTION

The viewing screen of a color image display, such as a CRT of the aperture-mask type, may be constituted of spaced elemental image areas of luminescent material that are selectively excited to luminescence to produce an image. One expedient used to improve the contrast of the luminescent image that is produced on the screen is a light-absorbing matrix adjacent the elemental areas of the screen. Such a matrix has the effect of substantially reducing the intensity of the ambient light that is reflected from the spaces between the elemental image areas of the screen.

Image displays including a light-absorbing matrix, methods for preparing the matrix, and materials constituting the matrix are disclosed, for example, in issued U.S. Pat. Nos. 3,558,310 to E. E. Mayaud, 4,049,452 to E. M. Nekut and 4,556,820 to R. P. Thompson. A preferred method for preparing a matrix, referred to as reverse printing, includes photographically producing a stencil of organic polymeric material on a support, coating the support with a slurry of particulate light-absorbing material, drying the coating and then removing the stencil with the overlying coating while leaving the coating in the open areas of the stencil in place. Luminescent materials are then deposited in the open areas of the matrix where the stencil was removed, after which the structure is subjected to at least a first baking in air at temperatures above 400° C. and a second baking in air at temperatures above 300° C.

Of all the matrix materials suggested previously, matrices of colloidal graphite and of carbon black have been the most used and the most successful. Both materials leave much to be desired. Colloidal graphite, although low in cost and relatively resistant to oxidation upon subsequent baking in air, is gray and less light-absorbing than carbon black, and produces matrices with less-than-desirable resolution due to relatively large average particle size in the range of 0.1 to 5.0 microns. Carbon black, although it is more light-absorbing and has a much smaller average particle size (in the range of 0.009 to 0.070 micron) than colloidal graphite, is much less resistant to oxidation upon subsequent baking in air than is colloidal graphite. Excessive oxidation of a carbon-black matrix results in poor light absorption, or requires the deposition of excessive amounts of carbon black to compensate for the material lost by oxidation.

It is desirable to provide a display comprising a matrix of light-absorbing particles that has lower cost, smaller particle-size-range and greater absorbing power of ambient light than previously-used colloidal graphite, and also greater resistance to oxidation upon subsequent baking in air than previously-used carbon black. The light-absorbing particles should produce aqueous slurries with good storage properties by ordinary factory processes, and should be compatible with prior matrix-making processes. The novel method satisfies these desirable characteristics.

SUMMARY OF THE INVENTION

The novel image display includes a viewing screen comprising spaced elemental picture areas and a light-absorbing matrix adjacent the picture areas, said matrix consisting essentially of partially-graphitized carbon black particles. The carbon black employed may be prepared by heating furnace black at temperatures above 1500° C. until the desired degree of graphitization is realized. The average particle size is in the range of 10 to 70 millimicrons. The novel image display may be prepared by the above-described prior methods except for the particulate partially-graphitized matrix material, and compositional and procedural adjustments to optimize the performance of the prior methods with partially-graphitized carbon black. In a preferred embodiment, the aqueous slurry consists essentially of partially-graphitized carbon black, PVA (polyvinyl alcohol) acidified with nitric acid to a pH of about 2.7 and a surfactant.

BRIEF DESCRIPTION OF THE DRAWINGS

FIG. 1 is a partially broken-away perspective view of a CRT of the shadow-mask type constructed according to the invention.

FIG. 2 is a front elevational view of a fragment of the viewing window of a CRT illustrating a matrix with a hexagonal array of image areas.

FIG. 3 is a front elevational view of a fragment of the viewing window of a CRT illustrating a matrix with a linear array of image areas.

FIG. 4 is a family of TGA (thermogravimetric analysis) curves comparing the weight loss upon baking in air of compositions of graphite, partially-graphitized carbon black and a binder, and colloid graphite and a binder.

DETAILED DESCRIPTION OF THE INVENTION

The novel image display comprises a viewing window and a viewing screen attached to one surface of the window. The viewing screen includes spaced elemental image areas and a light-absorbing matrix consisting essentially of partially-graphitized carbon black particles adjacent to the spaced elemental image areas. The matrix may outline the elemental image areas, partially fill the space therebetween, or, in the preferred form, completely fill the space between the elemental image areas. Furthermore, the image display may be of any type wherein a viewing screen includes elemental image areas. Thus, the image display may employ liquid crystals, light-emitting diodes, electroluminescent layers, photoluminescent layers or cathodoluminescent layers.

The preferred form of the novel image display is a CRT of the shadow-mask type, a typical form of which is shown in FIG. 1. The CRT 21 shown in FIG. 1 includes a glass faceplate panel 23 hermetically sealed to the wide end of a glass funnel 25. The funnel has an integral neck 27 at its narrow end, which is closed by a stem 29. A multibeam electron gun (not shown) is attached to the stem 29 and is housed within the neck 27. The faceplate panel 23 includes a viewing window 31 and a peripheral sidewall 33 hermetically sealed at its extended end to the wide end of the funnel 25. A viewing screen 35 is supported on the inner surface of the window 31. An apertured shadow mask 37 is supported on the sidewall 33, in closely-spaced relation with the viewing screen 35. The viewing screen includes an ordered array of elemental image areas of cathodoluminescent phosphors of three different emission colors, which are generally red-emitting, green-emitting and blue-emitting. The preferred phosphors are: for red-emitting $(Y,Eu)O_2S$, for green-emitting (Zn,Cd)S:Cu:Al and for blue-emitting ZnS:Ag. The elemental image areas may be dots in hexagonal array as shown in FIG. 2, or may be vertical lines in parallel array as shown in FIG. 3, for example. A black, light-absorbing matrix 39 and 41, respectively, in FIGS. 2 and 3 fills the space between the elemental areas. The light-absorbing matrix consists essentially of partially-graphitized carbon black particles. The novel image display may produce a single color or a multicolor image when it is operated.

In its simplest form, the novel method consists essentially of producing on the surface of a support a stencil of organic material whose geometric shape is substantially the negative of the pattern of the desired matrix. An aqueous slurry of particulate partially-graphitized carbon black matrix material is overcoated on the stencil and support surface and dried leaving a carbon-black layer overall. Then, the stencil and the portions of the carbon-black layer thereon are removed while retaining in place the carbon-black layer that is directly in contact with the support surface, thereby forming the desired matrix. The patterns of phosphors are then deposited to fill the openings in the matrix in the desired arrays. The stencil and the phosphor arrays are preferably produced photographically by known methods, for example, the methods disclosed in the above-cited patents.

EXAMPLE

A stencil and matrix are prepared similarly to the example disclosed in U.S. Pat. No. 4,049,452 op. cit., at columns 3 and 4, on the inner surface of a faceplate for an aperture-mask-type CRT. Briefly, the surface is coated with a film of dichromate-sensitized PVA (polyvinyl alcohol), the film is exposed to a pattern of light which insolublizes the irradiated areas of the film, and then the film is developed by removing all of the film but the insolublized areas. The stencil is next overcoated with a slurry containing, in percent by weight, 10% partially-graphitized carbon black (SL-175, marketed by Cabot Corporation, Boston, MA), 1.5% polyvinyl alcohol solids (Vinol 540, marketed by Air Products Co., New York, NY), 1.2% colloidal silica solids (Ludox AS, marketed by DuPont Chemical Co., Wilmington, DL), 0.6% surfactant (Pluronic L-92, marketed by Wyandotte Chemical Co., Wyandotte, MI) and the balance water. The slurry mixture is milled for 36 hours, filtered through lint-free paper, and then overcoated on the stencil. After the overcoating has dried, the stencil and the overlying overcoating are removed by the method disclosed in column 4 of U.S. Pat. No. 4,049,452. Briefly, a chemically-digestive agent such as 7 weight % hydrogen peroxide is applied to the overcoating causing the stencil to swell and soften, after which the material is flushed away, forming the matrix. Arrays of phosphor areas may then be deposited in the openings in the matrix, after which the structure may be filmed, aluminized, baked and then assembled into a CRT.

SOME GENERAL CONSIDERATIONS

Currently a commercial slurry of colloidal graphite is used to make the matrix coating on most faceplate panels. It is unfortunate that this key material is expensive, has poor shelf life and has only one supplier. Potential blackening pigments for the matrix coating tested, other than colloidal graphite, include black iron oxide and carbon black. However, these materials either are lost during bake out or interact with the phosphors.

An extensive analysis of the prior colloidal graphite slurry indicates it to be 20% colloidal graphite, 3% cellulosic resin and ammoniac water (pH=9 to 10). TGA (thermogravimetric analysis) studies found that the organic binder burned off at 200° to 300° C. in either an air or a nitrogen ambient. The colloidal graphite was lost at about 740° C. in air when a heating rate of 5° C./min was used. Kinetic studies reveal an activation energy of only about 10–15 Kcal/mole, instead of the anticipated 35–60 Kcal/mole for air oxidation of graphite. Pure ground graphite burned off at about 925° C. when a heating rate of 5° C./min was used. It was estimated from kinetic data that 11% of the colloidal graphite in a matrix is lost during factory processing, which processing requires about 2 hours above 400° C. This is the cause of the reduced light absorption by the matrix.

Conventional carbon blacks made by the furnace method are mostly particles in the 10 to 70 nanometer diameter range. The larger particles burn slower and the smaller particles are blacker. The amount of surface oxygen is also a factor and particles with 1% or less of surface oxygen are more resistant to air oxidation. Evaluation of several types of furnace blacks found them to be completely burned off when heated in air at 460° C. for 2 hours. TGA studies found them to burn off at about 500°–700° C. when a heating rate of 5° C./min was used. A laboratory sample of furnace carbon black that was completely graphitized at 2700° C. was not completely burned off until 875° C. The partially-graphitized carbon black used in the novel method may be prepared by heating furnace black above 1500° C. for at least 4 hours until the desired degree of graphitization is achieved.

FIG. 4 shows TGA curves obtained for ground natural graphite, curve 51; the above-disclosed partially-graphitized carbon black SL-175 and binder composition, curve 53; and the colloidal graphite and binder composition, curve 55, of the commercial slurry presently used. Each composition was baked in air with the baking temperature increasing at a regular rate of 5° C./minute. These curves show that the weight loss for partially-graphitized carbon black, upon baking, though greater than for graphite, is much less than for the presently-used colloidal graphite matrix material. In addition to the improved resistance to oxidation, the partially-graphitized carbon blacks used in the novel method produce slurries with greatly improved shelf lives. In this test, the average particle sizes were, for ground natural graphite, about 75 microns (200 mesh); for partially-graphitized carbon black, about 0.04 micron; and for the colloidal graphite, about 0.5 micron.

A matrix of colloidal graphite appears gray, not black, when compared directly with carbon black coatings. This difference in blackness is due to the relative size of the graphite and carbon black particles. The colloidal graphite (the smallest type of commercially-available graphite made by slurry milling) is made of platelets of roughly 0.1 to 5.0 microns in size, with a diameter-to-thickness ratio of about 50:1. In the case of Aquadag E, SEM (scanning electron microscope) indicates a median size of the colloidal graphite particles of 0.5 micron or larger. Commercial carbon blacks are made with a range of median particle sizes of from 0.009 to 0.070 micron. The carbon black coatings appear blacker than the colloidal graphite coating because the smaller carbon black particles are more efficient in dispersing incident light. The smaller size of the carbon black particle is also the reason for the potentially higher dot or line definition of the new formulation.

Light reflection values of coatings of colloidal graphite previously used in matrices and of the partially-graphitized carbon black disclosed herein were measured both directly off the coatings and off the coatings through the display panel glass. The degree of blackness was obtained by measuring in foot-lamberts the specular (mirrorlike) and diffused reflections of the coatings at various angles and lighting conditions. Direct specular values of the colloidal graphite coating were about 8 times that of partially-graphitized carbon black. In all other tests, specular values for colloidal graphite coatings were at least 50% greater than the specular values for partially-graphitized carbon black. It was postulated that the difference would be greater (i.e., greater than 50%) on a roughened glass surface.

Diffuse reflection values are normalized to a 0.8 value for white paper. Typically, pigmented phosphors exhibit a value of 0.6 and unpigmented phosphors exhibit a value of 0.8. Again, the colloidal graphite coatings exhibited 50% greater reflection than the partially graphitized carbon black coatings, whether measured directly or through the panel glass. However, the reflectance of the phosphor, which covers 35% of the display faceplate, predominates, and the greater blackness of the partially-graphitized carbon black coating translates to a 1% gross improvement in screen face reflectance.

Cathode-ray tubes of the type shown in FIG. 1, with screens of the type shown in FIG. 2, were prepared and tested for front reflectance of the screens. Screens prepared with a partially-graphitized carbon-black matrix exhibited about a 5% reduction in reflectance from the screens, as compared with similar screens with a colloidal-graphite matrix.

What is claimed is:

1. In an image display including a viewing screen comprising spaced elemental image areas and a light-absorbing matrix adjacent said spaced areas, the improvement comprising said matrix consisting essentially of partially-graphitized carbon black particles.

2. The display defined in claim 1 wherein a dry mass of said particles exhibits a TGA (thermogravimetric analysis) curve that is between and displaced from the TGA curves both of ground natural graphite platelets passing a 200-mesh screen and of colloidal graphite particles about 0.5 micron in size.

3. The display defined in claim 2 wherein said curves are produced at a heating rate of 5° C./min., and said displacements are more than 50° C. and less than 200° C.

4. The display defined in claim 1 wherein a layer of said particles has a direct specular reflection of about 4 foot-lamberts and a diffuse reflection of about 0.8 foot-lamberts.

5. The display defined in claim 1 wherein said partially-graphitized carbon black is prepared by heating furnace black at temperatures above 1500° C. for at least 4 hours.

6. The display defined in claim 1 wherein said viewing screen is attached to the inner surface of the viewing window of a multi-color cathode-ray tube, and each of said elemental image areas is filled with cathodoluminescent material.

7. The display defined in claim 6 wherein said tube is a color television picture tube and said elemental areas is an ordered array of red-emitting, green-emitting and blue-emitting cathodoluminescent material.

* * * * *